US008220670B2

(12) United States Patent
Moribata et al.

(10) Patent No.: US 8,220,670 B2
(45) Date of Patent: Jul. 17, 2012

(54) DISCHARGEABLE CAP

(75) Inventors: Yoshihisa Moribata, Kobe (JP); Seiichi Ido, Nishinomiya (JP); Maya Mitsumatsu, Nishinomiya (JP); Tsutomu Kobayashi, Ibaraki (JP)

(73) Assignees: The Procter & Gamble Company, Cincinnati, OH (US); Yoshino Kogyosho Co., Ltd., Tokyo (JP)

( * ) Notice: Subject to any disclaimer, the term of this patent is extended or adjusted under 35 U.S.C. 154(b) by 676 days.

(21) Appl. No.: 11/922,087

(22) PCT Filed: Oct. 24, 2006

(86) PCT No.: PCT/JP2006/321088

§ 371 (c)(1),
(2), (4) Date: Dec. 13, 2007

(87) PCT Pub. No.: WO2007/052490

PCT Pub. Date: May 10, 2007

(65) Prior Publication Data

US 2010/0032454 A1 Feb. 11, 2010

(30) Foreign Application Priority Data

Oct. 31, 2005 (JP) ..... 2005-315943

(51) Int. Cl.

| | |
|---|---|
| ***B65D 5/72*** | (2006.01) |
| ***B65D 47/00*** | (2006.01) |
| ***B65D 39/00*** | (2006.01) |
| ***B65D 51/16*** | (2006.01) |
| ***A01J 21/00*** | (2006.01) |
| ***A62C 31/02*** | (2006.01) |

(52) U.S. Cl. ..... 222/494; 222/490; 222/546; 222/556; 215/235; 220/203.17; 425/461; 239/601

(58) Field of Classification Search ..... 222/80, 222/81, 82, 490, 491, 492, 493, 494, 546, 222/548, 554, 556, 563, 562, 526, 531, 575, 222/212; 215/247, 249, 235, 320; 220/203.8, 220/203.17, 203.18, 259.1, 259.3, 837, 255; 425/461, 191; 239/601, 599

See application file for complete search history.

(56) References Cited

U.S. PATENT DOCUMENTS 2,441,649 A * 5/1948 Sprague ..... 222/92

(Continued)

FOREIGN PATENT DOCUMENTS

JP U-3002666 7/1994

(Continued)

*Primary Examiner* — Kevin P Shaver
*Assistant Examiner* — Stephanie E Williams
(74) *Attorney, Agent, or Firm* — Oliff & Berridge, PLC

(57) ABSTRACT

An ejector cap which can impart a whipped cream-like appearance to a body care composition at the time of ejection. In order to find the arrangement of an ejection opening, a main means comprises a cap body fixed to a container and having an ejection opening in the top wall, and a lid movable freely between an open position and a close position. In the ejection cap for ejecting a body care composition, contained in the container and having viscosity of 10,000-50,000 Pas, from the ejection opening, the cap body has a dome portion on the top wall, and the ejection opening is of a central opening formed in the center of the dome portion and at least three leg-like openings extending radially outward from the central opening. The lid has an enclosing function for preventing leakage of the body care composition from the ejection opening at the close position.

16 Claims, 4 Drawing Sheets

U.S. PATENT DOCUMENTS

| | | | | |
|---|---|---|---|---|
| 3,785,560 | A * | 1/1974 | Hruby, Jr. | 239/17 |
| 3,927,796 | A * | 12/1975 | Whitehouse | 220/281 |
| 6,089,411 | A * | 7/2000 | Baudin et al. | 222/212 |
| 6,153,238 | A * | 11/2000 | Shannon | 426/115 |
| 7,128,244 | B2 * | 10/2006 | Antal, Sr. | 222/153.01 |
| 7,503,469 | B2 * | 3/2009 | Bloom et al. | 222/494 |
| 7,628,297 | B2 * | 12/2009 | Pugne | 222/556 |
| 2004/0232169 | A1 | 11/2004 | Glover et al. | |
| 2007/0029352 | A1 * | 2/2007 | Norris et al. | 222/494 |
| 2010/0062096 | A1 * | 3/2010 | Clauwaert et al. | 425/376.1 |

FOREIGN PATENT DOCUMENTS

| | | |
|---|---|---|
| JP | U-2603820 | 1/2000 |
| JP | A-2005-96776 | 4/2005 |

* cited by examiner

[Fig. 1]
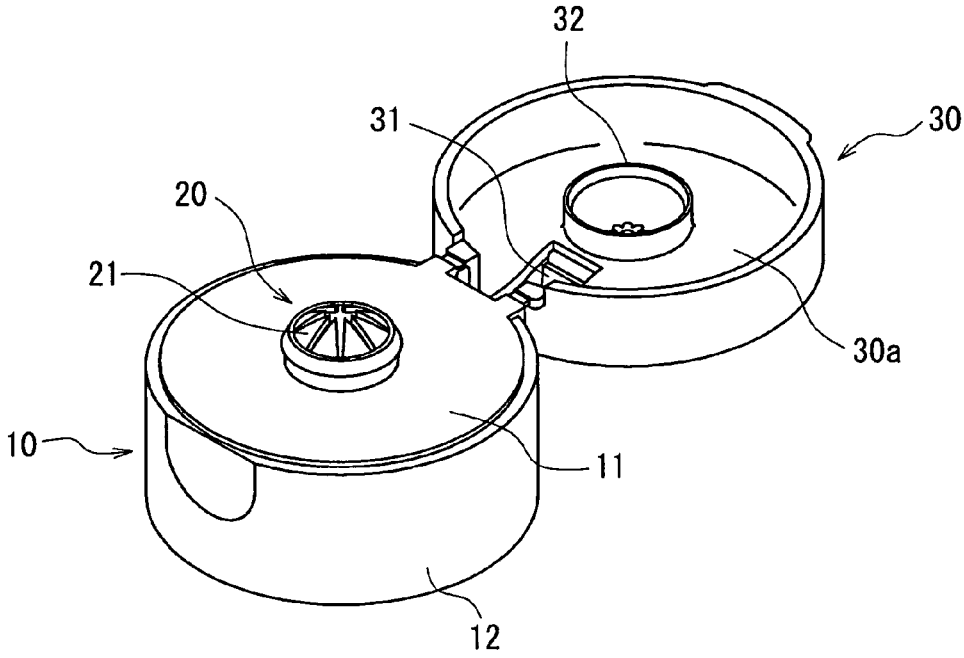
[Fig. 2]
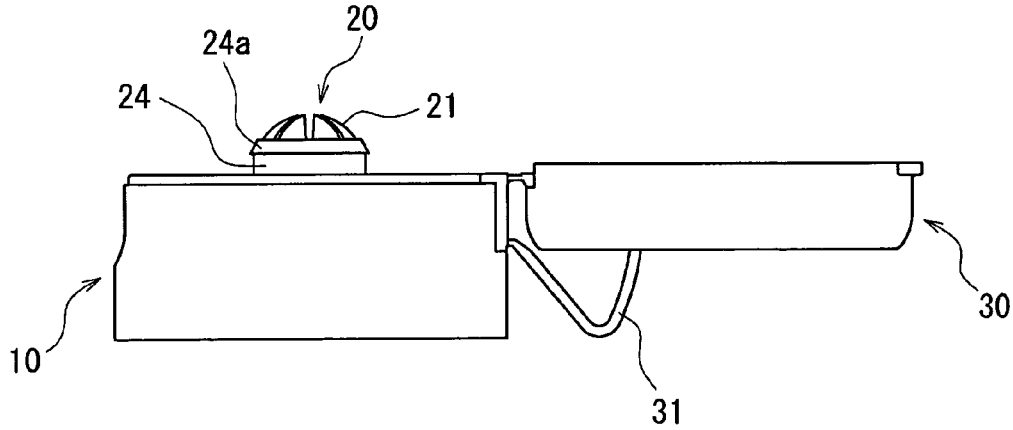

[Fig. 3]
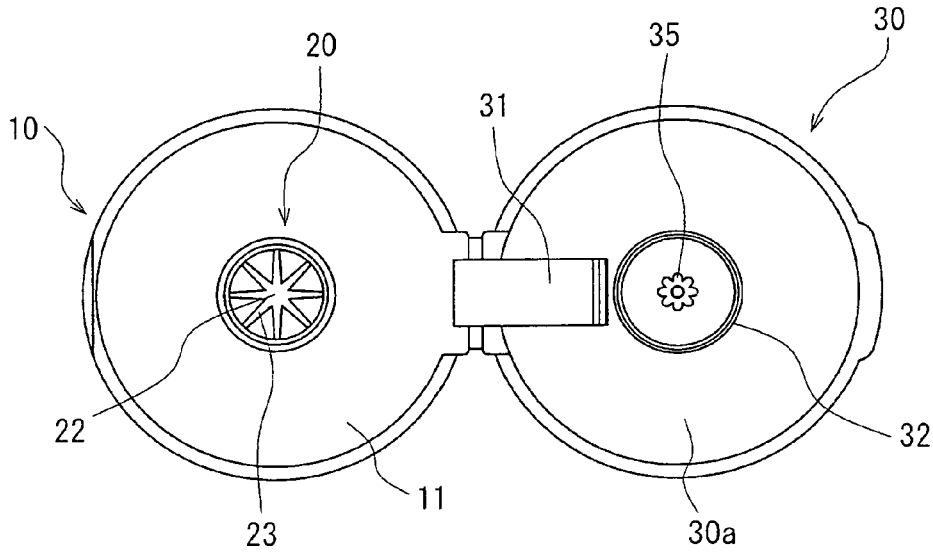
[Fig. 4]
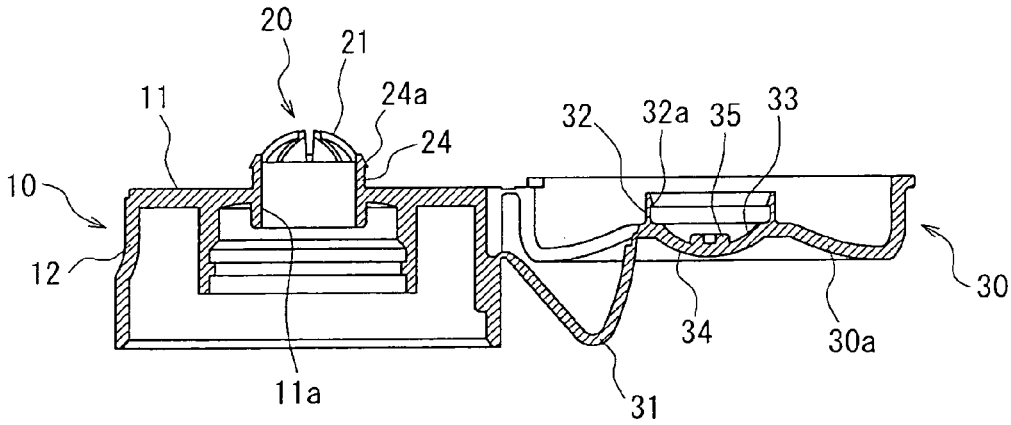

[Fig. 5]
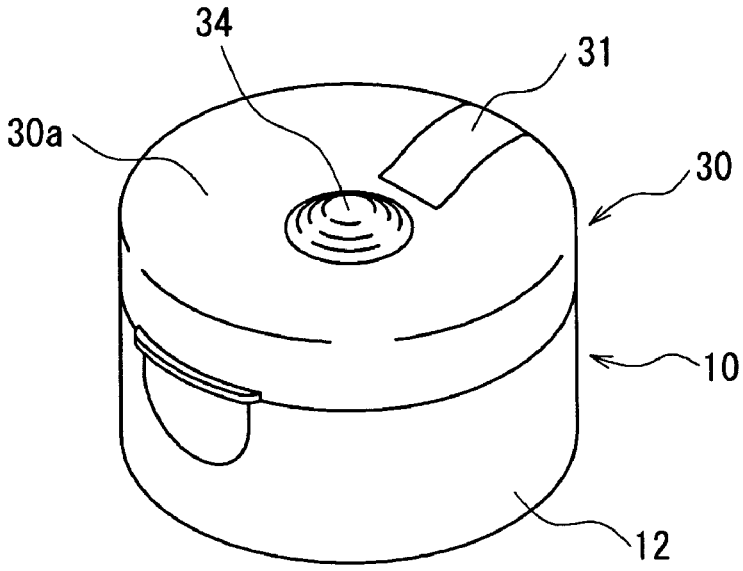
[Fig. 6]
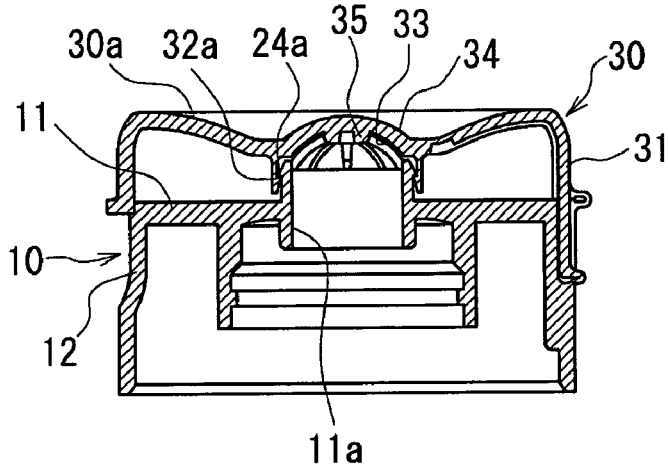

[Fig. 7]
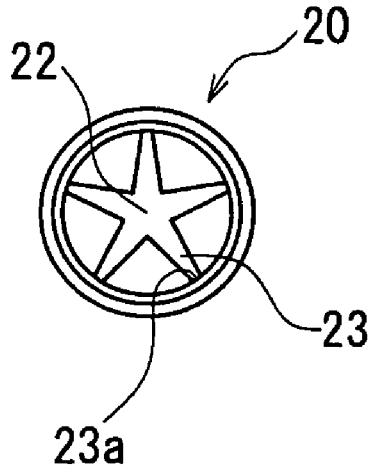

DISCHARGEABLE CAP

TECHNICAL FIELD

This invention relates to a dischargeable cap which is used by being fitted to a container containing a body-care composition and which gives an appearance of whipped cream to the body-care composition when it is discharged through this cap.

BACKGROUND ART

Various body-care compositions are put in the containers in varied shapes, and are utilized by discharging the composition through the dischargeable cap fitted to the container. Such containers include a tubular container, a bottle, or a pump-equipped bottle, all of which are provided with a dischargeable cap having an opening for the discharge, (See patent document 1).

[Patent document 1] Registered utility model JP 2603820 U

The body-care compositions to be put in such containers include, for example, skin cleansing compositions, skin conditioning compositions, sun screen compositions, and hair care compositions, such as hair shampoo compositions, hair conditioning compositions, and hair styling compositions. These body-care compositions are provided in the forms of lotions, cream, gel, and emulsions.

DISCLOSURE OF THE INVENTION

Technical Problem to be Solved by the Invention

The products concerning above-described body-care compositions are required to differentiate themselves from other products of the same kind. For this purpose, the cleansing effect, the conditioning effect, and/or the hair-styling effect of respective products has to be emphasized as far as possible. And the features of the product having such effects must gain the recognition of consumers. In addition to the above-described conditioning and other effects, these products also need to differentiate themselves by attracting attention of consumers from the points of view of beauty and uniqueness in appearance (hereinafter referred to as "esthetic appearance"). In short, for the dischargeable cap used with a body-care composition, it is required to emphasize the above-described conditioning and other effects, and/or to make the consumers recognize the features of the products having these effects, and/or to add esthetic appearance or other values to the products having such effects. Up to now, there is no known product which has all of the above-described features.

The technical problem to be solved by this invention is to discover a structure of the dischargeable cap that can give appearance of whipped cream to each body-care composition when it has been discharged through this cap. The object of this invention is to provide a dischargeable cap that can emphasize the conditioning and other effects of body-care compositions, and/or to make consumers recognize the features of the products having these effects, and/or add esthetic appearance and other values to the discharged composition.

Means of Solving the Problem

The means of carrying out this invention to solve the above-described technical problem is a dischargeable cap comprising a cap main body which is fitted to a container and is provided with a discharge opening formed on top surface, and a lid which can be moved from a fully open position to a closed position, and vice versa, said cap being used to discharge, thorough the discharge opening, a body-care composition which has been put in a container and has a viscosity in the range of about 10,000 mPa·s to about 50,000 mPa·s, wherein said cap main body has a dome portion formed on the top surface to make the dome portion serve as the discharge opening, the discharge opening comprising a central opening formed at the center of the dome and at least three slits that extend radially outwardly from the central opening, and wherein the lid has sealing functions to prevent the body-care composition from leaking through the discharge opening at the closed position.

The dischargeable cap of this invention to be used for body-care compositions can make consumers fully recognize the product features associated especially with the effects of conditioner compositions, and/or add esthetic appearance, especially the appearance of whipped cream to the composition that has been discharged through this cap.

The dischargeable cap of this invention enables multiple ridges to be formed on the surface of the body-care composition that has been discharged through this cap. These ridges should be able to show effectively that the composition is highly viscous, to emphasize the effects of the body-care composition further, and especially the conditioning effects of the conditioner composition, and/or to make consumers fully recognize the features of the products having these effects. For those consumers who ask for improved conditioning effects, high viscosity of the composition is further emphasized to gain their recognition as to the improved conditioning effects of the composition.

The discharged body-care composition having such ridges is likely to have better esthetic appearance, as compared to the counterpart having no ridge when it is discharged through a conventional opening of a publicly known cap. The users have a preference for relatively clear ridge shape because these ridges further emphasize, and/or make users aware of, the service result of the body-care composition, and/or because these ridges give esthetic appearance.

Effects of the Invention

The principal means of this invention is as described above. The dischargeable cap of this invention can give the appearance of whipped cream to the body-care composition when it is discharged through the cap, further emphasize the conditioning and other effects of the body-care compositions, make consumers fully aware of these effects, and/or give esthetic appearance to the discharged composition. The action and effect other than described above will be known to those skilled in the art from further description given below by referring to the attached drawings.

BRIEF DESCRIPTION OF THE DRAWINGS

FIG. 1 is a perspective view of the entire dischargeable cap in one embodiment of this invention, with its lid at the fully open position.

FIG. 2 is a side elevational view of the dischargeable cap of FIG. 1.

FIG. 3 is a plan view of the dischargeable cap of FIG. 1.

FIG. 4 is a vertical section of the dischargeable cap of FIG. 1.

FIG. 5 is a perspective view of the entire dischargeable cap of FIG. 1, with its lid at the closed position.

FIG. 6 is a vertical section of the dischargeable cap in the state of FIG. 5.

FIG. 7 is a plan view showing another shape of the discharge opening.

EXPLANATION OF CODES

10. Cap main body
11. Top surface
11*a*. Opening
12. Side wall
20. Discharge opening
21. Dome portion
22. Central opening
23. Slit
23*a*. Lower end
24. Second cylindrical segment
24*a*. Second latching ridge
30. Lid
30*a*. Lid plate
31. Hinge
32. First cylindrical segment
32*a*. First latching ridge
33. Concave portion
34. Convex portion
35. Sealing piece

A PREFERRED EMBODIMENT OF THE INVENTION

This invention is further described with respect to a preferred embodiment of the dischargeable cap of this invention, now referring to the drawings. In the following description, the term "comprise" means that another or other actions and/or constituents can be added within the scope in which these actions and/or constituents do not affect the action and effect of this invention. The term "comprise" includes the terms "consist of" and "basically consist of." Percentage, part, and ratio are based on the total weight of the composition of this invention, unless otherwise indicated. The weight of enumerated components is on the active level, and therefore, does not contain base materials and by-products contained in commercial materials. The term "mixture" in this specification includes a simple combination of materials and includes also those compounds that may arise from such combination.

FIGS. 1-6 shows the dischargeable cap in an embodiment of this invention. This dischargeable cap comprises a cap main body 10 to be fitted to a container, and a lid 30. The dischargeable cap is described below with respect to the cap main body 10, a discharge opening 20, the lid 30, a sealing function of the cap, and a body-care composition.

[The Cap Main Body]

The cap main body 10 is fitted to a container. In the embodiment shown in FIGS. 1-6, the cap main body 10 has an almost cylindrical shape, and comprises a top surface 11 and a side wall 12 disposed vertically from the top surface 11. The cap main body 10 can be fitted to the container by any adequate method, such as screw engagement or fit, or can be formed integrally with the main body of the container. As shown, the cap main body 10 has a roughly circular shape in its plain cross-section, but can have rectangular or other shapes or constructions.

[The Discharge Opening]

The above-described cap main body 10 has a discharge opening 20 in the top surface 11. In this invention, the cap main body 10 has also a dome portion 21 at the center of the top surface 11. The discharge opening 20 is formed inside this dome portion 21. The configuration of the discharge opening 20 inside the dome portion 21 ensures that the shape of ridges can be formed more clearly for the discharged body-care composition than in the case of a discharge opening 20 in a flat surface.

This discharge opening 20 has a central opening 22 and at least three slits 23 that extend in a radial pattern outward from the central opening 22 (See FIG. 3). Esthetic appearance of the discharged body-care composition can be improved preferably by forming 4 to 10 slits 23 and more preferably by forming 5 to 8 slits.

In the embodiment shown in the drawings, the discharge opening 20 is disposed in the dome portion 21 that is formed on the top surface 11 of the cap main body 10, as shown in FIGS. 1 and 2. The discharge opening 20 has also the central opening 22 and eight slits 23, as shown in FIG. 3.

In order for the ridges to be formed clearly in the discharged body-care composition, it is important to define the details of other structures of the discharge opening 20. Such details include the ratio of the diameter of the central opening 22 to the length of the slits 23, the ratio of width to length of the slits 23 as well as the shape of the slits, and/or the ratio of height to diameter of the dome portion 21. The ratio of the diameter of the central opening 22 to the slit length is preferably in the range of about 2:1 to about 1:8, and more preferably about 1:1 to about 1:6. The ratio of average width to length of the slits 23 is in the range of preferably about 1:1 to about 1:8 and more preferably about 1:2 to about 1:6.

The discharge opening 20 comprising the central opening 22 and the slits 23 can have an asterisk-like shape if the slits have a rectangular shape. The discharge opening 20 can also be in a star shape if the slits have a triangular shape, as shown in FIG. 7.

In the case of rectangular slits, a long rectangular shape is especially preferred. In such a shape, too, the ratio of width to length in the above-described range should be used. In the case of triangular slits, an acute triangular shape is especially preferred. In this case, too, the ratio of width to length in the above-described range should be used. Each side of the slit has an angle in the range of about 5 degrees to about 30 degrees at the lower end 23*a* of the slit 23 (See FIG. 7).

The ratio of height to diameter of the dome portion 20 is in the range of preferably about 1:2 to about 1:5 and more preferably about 1:3 to about 1:4.

[The Lid]

The dischargeable cap of this invention has a lid 30 which is movable between the fully open position when the container is in use and the closed position when it is not used. It is preferred that the lid 30 can be resiliently turned over at one end by way of a hinge 31 from a point of view of compatibility with the later-described sealing function (especially, the sealing function (iii). The lid of other types, such as the fitting type or the screw engagement type, can also be used in this invention.

The lid 30 in the embodiment shown in FIGS. 1-6 has an almost circular lid plate 30*a*, and the lid shape is complementary with the shape of the cap main body 10. However, any other shapes can be used optionally as long as such shapes are complementary with the shape of the cap main body 10. The lid 30 shown in the drawings is of the type in which the lid 30 is connected to the cap main body 10 by way of the flexible hinge 31 and can be turned over resiliently. The hinge 31 makes it possible for the lid 30 to rotate from the closed position to the fully open position and vice versa. At the fully open position, the lid 30 has been rotated and turned over so as to leave the top surface 11 of the cap main body 10. In that state, the body-care composition can be discharged from the container. At the closed position, the lid 30 covers the top surface 11 of the cap main body 10, as shown in FIGS. 5 and 6.

[The Sealing Functions]

The above-described lid 30 has sealing functions by which the lid 30 prevents the body-care composition from leaking when the lid 30 is at the closed position. These sealing functions include at least one of items (i) to (iv), below:

(i) A sealing function accomplished by a first latching ridge and a second latching ridge, wherein the first latching ridge is disposed on the inner peripheral wall of the first cylindrical segment which is vertically hanged from the underside of the lid 30 and wherein the second latching ridge is disposed on the outer peripheral wall of the second cylindrical segment so as to surround the opening that has been cut in the top surface of the cap main body. The dome portion is formed on the upper end of the second cylindrical segment in such a way that the second cylindrical segment increases the height of the dome portion. In the embodiment shown in the drawings, the first cylindrical segment, the first latching ridge, the second cylindrical segment, and the second latching ridge are designated as 32, 32*a*, 24, and 24*a*, respectively.

(ii) A sealing function accomplished by a concave portion formed on the underside of the lid. This concave portion is designed to cover the dome portion fittingly when the lid is at the closed position.

(iii) A sealing function accomplished by the sealing pieces formed on the underside of the lid. The shape of these sealing pieces is complementary with the shape of at least the central opening of the discharge opening. The sealing pieces are disposed so as to be fitted at least in the central opening of the discharge opening when the lid is at the closed position.

(iv) Combinations of (i) to (iii), above.

When the lid has the sealing function (ii), it is preferred that the lid has a convex portion in the area corresponding to the concave portion, but on the topside of the lid. This configuration enables the lid to have roughly the same thickness over the entire lid plate, thus preventing surface sink in the topside and improving moldability.

When the lid has the sealing function (iii), it is also preferred that the sealing pieces are complementary with the shape of the slits, in addition to the complementarity with the central opening of the discharge opening. When the lid is at the closed position, the sealing pieces are fitted in the central opening of the discharge opening and also in the slits as far as about 5-100%, preferably about 10-50%, and more preferably about 10-30% of the total length of each slit.

The dischargeable cap in the embodiment shown in FIGS. 1-6 has all the sealing functions of (i) to (iii). As shown in FIGS. 4 and 6, the sealing function (i) of this dischargeable cap comprises the first latching ridge 32*a* and the second latching ridge 24*a*, which are latched together when the lid 10 is at the closed position (See FIG. 6). The first cylindrical segment 32 is hanged from the underside of the lid plate 30*a* of the lid 30. The above-described first latching ridge 32*a* is disposed peripherally at the lower end of the inner wall of this first cylindrical segment. An opening 11*a* is formed at the center of the top surface 11 of the cap main body 10. The second cylindrical segment extends upright from the peripheral edge of the opening 11*a* to the upper end where the dome portion 21 is formed. The above-described second latching ridge 24*a* is disposed peripherally at the upper end of the outer wall of this second cylindrical segment.

If the dischargeable cap has the above-described sealing function (i), then it would be better for the lid 10 to make a click sound at each time of latch engagement or latch release from the engagement between the first latching ridge 32*a* and the second latching ridge 24*a* when the lid 10 is opened or closed. This click sound allows the user to confirm the open-close operation by sound, too.

As shown in FIGS. 4 and 6, the dischargeable cap has also the sealing function (ii). The concave portion 33 is disposed on the underside of the lid plate 30*a* of the lid 30 so as to cover tightly the dome portion 21 at the closed position of the lid 30. The sealing function (ii) is accomplished by this concave portion 33 which covers the dome portion 21 (See FIG. 6). FIGS. 4-6 also show that the convex portion 34 is formed on the topside of the lid plate 30*a* of the lid 30 in the area corresponding to the concave portion 33.

This dischargeable cap has also the sealing function (iii), as shown in FIGS. 3, 4, and 6. The sealing pieces 35 project from the underside of the lid plate 30*a* of the lid 30. These sealing pieces 35 have a complementary shape with the shape of at least the central opening 22 of the discharge opening 20. The sealing function (iii) is accomplished when the sealing pieces 35 are fitted in at least the central opening 22 of the discharge opening 20 at the closed position of the lid 30. FIGS. 3 and 6 show that in this embodiment, the sealing pieces 35 are also in the complementary shape with a part of each slit 23 including about 10-30% of the slit length, besides being complementary with the shape of the central opening 22.

The three sealing functions can be combined with one another, as found in a combination of (i) and (iii), a combination of (ii) and (iii), and the like.

[The Container]

The dischargeable cap of this invention is used by being fitted to a container. Examples of the container include a tubular container and a bottle. It is preferred in this invention that the body-care composition can be discharged through the opening of the cap by squeezing the container body. It is also possible to use other methods of discharging the body-care composition from the container.

[The Body-Care Composition]

The body-care compositions involved in this invention have a viscosity in the range of about 10,000 mPa·s to about 50,000 mPa·s and preferably about 18,000 mPa·s to about 35,000 mPa·s so as to improve the esthetic appearance of the discharged composition. The above-described viscosity levels were measured with a Brookfield viscometer under the conditions of a temperature of 27.6 deg C. and a rotating speed of 1.0 rpm.

The body-care compositions involved in this invention include, for example, skin cleansing compositions, skin conditioning compositions, sun-block compositions, and hair-care compositions including hair shampoo compositions, hair conditioning compositions, and hair styling compositions. The body-care compositions of these types can be in the forms of lotion, cream, gel, and emulsion as long as they have a viscosity in the cited ranges.

It is preferred that the body-care compositions have a conditioning effect and/or contain a conditioner. It is more preferred that the conditioning compositions contain at least one conditioner selected from the group consisting of a cationic polymer, a cationic surface active agent, silicone, an aliphatic compound, and a mixture thereof. A conditioning composition containing a cationic surface active agent and an aliphatic compound is especially preferred. The cationic surface active agent and the aliphatic compound form a gel matrix with an aqueous carrier. Such a gel matrix gives smooth touch to the wet hair and also gives softness and moisture to the dry hair. Thus, the gel matrix is suitably used to obtain various conditioning effects.

If the composition contains a gel matrix, it is preferred from the aspect of gel matrix stability that the composition hardly contain an anionic surface active agent and an anionic polymer. By "hardly containing an anionic surface-active agent and an anionic polymer," it is meant in this invention that the total content of an anionic surface active agent and an anionic polymer in this composition is 1% or less, preferably 0.5% or less, and more preferably 0%

The cationic surface active agents useful for the body-care compositions include quaternary ammonium salts such as, for example, biphenyl trimethyl ammonium chloride, cetyl trimethyl ammonium chloride, and stearyl trimethyl ammonium chloride. Other useful cationic surface active agents include a salt of amide amine and an acid in which the molar ratio of acid to amide amine is in the range of about 1:0.3 to about 1:1.3. As examples of these salts of amide amine and acid, there may be mentioned a salt of stearamide propyldimethylamine and an acid selected from L-glutamic acid, lactic acid, citric acid and a mixture thereof. As examples of aliphatic compounds useful in the body-care composition, there may be mentioned cetyl alcohol, stearyl alcohol, and biphenyl alcohol.

The cationic surface active agent can be used in the composition at a level in the range of about 0.1% by weight to about 10% by weight. The aliphatic compound can be used in the composition at a level in the range of about 5% by weight to about 20% by weight. The weight ratio of the cationic surface active agent to the aliphatic compound is preferably in the range of about 1:1 to 1:10 and more preferably 1:1 to 1:4 from the aspect of gel matrix formation.

EXAMPLE

The following example is provided to illustrate the above-described embodiment of this invention more specifically and clearly. The example serves to give better understanding of this invention and should not be construed as limiting this invention in any way. Thus, various alterations and modifications can be made, and many variations can be given, without departing from the idea and scope of this invention.

Example 1

In the dischargeable cap shown in FIGS. 1-6, the central opening 20 has a diameter of about 2.6 mm. The cap has also 8 slits 23 in a rectangular shape, each of which has a width of about 0.6 mm and a length of about 3.7 mm. The dome portion 21 has a height of about 2.5 to 2.8 mm and a diameter of about 10 mm.

This dischargeable cap is used by being fitted and fixed to a tubular container by undercut engagement. The tubular container contains a hair conditioning composition, which comprises a gel matrix having a viscosity in the range of about 20,000 mPa·s to 25,000 mPa·s and consisting of a cationic surface active agent and an aliphatic compound. This hair conditioning composition can be discharged from the container through the discharge opening 20 by squeezing the container body.

The hair conditioning composition has clear-cut ridges and gives the appearance of whipped cream when it is discharged. Such appearance makes it possible to show emphatically the conditioning effect of the body-care composition (a hair conditioning composition in this example), and/or to make the consumers recognize these effects, and/or to give esthetic appearance to the discharged composition.

The document cited in the description of the specification should be taken merely as reference, and in no way teaches or discloses this invention. If the meaning or definition of a term used in this specification is different from that of the term in the document used for reference, then the meaning or definition of the term used in this specification shall have priority.

This invention was illustrated and described above with respect to a specific embodiment. However, it is to be understood by those skilled in the art that various modifications and alterations can be made without departing from the idea and scope of this invention. Therefore, it is intended that these modifications and alterations are included in the scope of this invention.

INDUSTRIAL APPLICABILITY

The dischargeable cap of this invention can create clear-cut ridges on the discharged body-care composition, and gives appearance of whipped cream. This cap can be used with various body-care compositions and with containers in various shapes. Thus, wide application of use can be expected.

The invention claimed is:

1. A dischargeable cap comprising:

a cap main body to be fitted to a container and provided with a discharge opening formed on a top surface; and a lid that can be moved from a closed position to a fully open position and vice versa, the cap being used to discharge, through the discharge opening, a body-care composition which has been put in the container and has a viscosity in a range of about 10,000 mPa·s to about 50,000 mPa·s, wherein the cap main body has a semi-spherical dome portion to be formed on the top surface and to be used as the discharge opening, the discharge opening comprising a central opening formed at the center of the dome, and at least three slits that each have a lower end and extend radially outwardly from the central opening, sides of the slits at the lower end form an angle in a range of about 5 to 30 degrees, the dome portion forms an arched roof, and the lid has sealing functions to prevent the body-care composition from leaking through the discharge opening at the closed position, and wherein a first cylindrical segment is disposed vertically on an underside of the lid and is provided with a first latching ridge disposed on an inner peripheral wall of this first cylindrical segment, and a second cylindrical segment is disposed upright from an edge of the discharge opening, is provided with a second latching ridge disposed on an outer peripheral wall of the second cylindrical segment and is provided with the dome portion on an upper end of the second cylindrical segment, and wherein the first cylindrical segment is fitted to the second cylindrical segment at the closed position of the lid so that the first latching ridge and the second latching ridge exhibit a sealing function.

2. The dischargeable cap according to claim 1, wherein another sealing function is accomplished by a concave portion formed inside the lid so as to cover the dome portion at the closed position of the lid.

3. The dischargeable cap according to claim 1, wherein sealing pieces in a complementary shape with the shape of at least the central opening of the discharge opening are projected from the underside of the lid and wherein the sealing pieces are fitted in at least the central opening of the discharge opening to accomplish another sealing function.

4. The dischargeable cap according to claim 1, wherein the sealing pieces to be projected from the underside of the lid are in the shape that is complementary with the central opening and with a part of each slit including at least about 10 percent to about 30 percent as much as the length of each slit of the discharge opening and wherein at the closed position of the lid, the sealing pieces are fitted in the central opening and in at least about 10 percent to about 30 percent as much as the length of each slit of the discharge opening to accomplish the sealing function.

5. The dischargeable cap according to claim 1, wherein the lid is connected to the cap main body by a hinge in such a manner that the lid is movable reciprocally from the fully open position to the closed position, and vice versa.

6. The dischargeable cap according to claim 1, wherein a concave portion is formed on the underside of the lid to have the dome portion covered when the lid is at the closed position and wherein a convex portion is also formed on the outer surface of the lid in the area corresponding to the concave portion.

7. The dischargeable cap according to claim 1, wherein the ratio of the diameter of the central opening to the length of each slit is in the range of about 2:1 to about 1:8.

8. The dischargeable cap according to claim 1, wherein the ratio of the diameter of the central opening to the length of each slit is in the range of about 1:1 to about 1:6.

9. The dischargeable cap according to claim 1, wherein the ratio of average width to length of each slit is in the range of about 1:1 to about 1:8.

10. The dischargeable cap according to claim 1, wherein the ratio of average width to length of each slit is in the range of about 1:2 to about 1:6.

11. The dischargeable cap according to claim 1, wherein each slit is in the shape of a rectangle.

12. The dischargeable cap according to claim 1, wherein the ratio of height to diameter of the dome portion is in the range of about 1:2 to about 1:5.

13. The dischargeable cap according to claim 1, wherein the ratio of height to diameter of the dome portion is in the range of about 1:3 to about 1:4.

14. The dischargeable cap according to claim 1, wherein the discharge opening has 4 to 10 slits.

15. The dischargeable cap according to claim 1, wherein the discharge opening has 5 to 8 slits.

16. The dischargeable cap according to claim 1, wherein the body-care composition to be put in the container has a viscosity in the range of about 18,000 mPa·s to about 35,000 mPa·s.

* * * * *